US005094414A

United States Patent [19]

Eddy, Jr.

[11] Patent Number: 5,094,414

[45] Date of Patent: Mar. 10, 1992

[54] SUSPENSION HANGER FOR RESEALABLE PLASTIC BAG

[75] Inventor: Allan F. Eddy, Jr., Greenwell Springs, La.

[73] Assignee: Protune of Louisiana, Inc., Greenwell Springs, La.

[21] Appl. No.: 611,070

[22] Filed: Nov. 8, 1990

[51] Int. Cl.[5] ..... B65B 67/00

[52] U.S. Cl. ..... 248/95; 211/113; 211/46; 248/215; 248/340

[58] Field of Search ..... 248/95, 690, 312.1, 248/340, 215, 305, 307, 99; 211/113, 46, 74; 383/78, 81

[56] References Cited

U.S. PATENT DOCUMENTS

| | | | |
|---|---|---|---|
| 2,223,978 | 3/1940 | Dew | 211/46 X |
| 2,447,771 | 8/1948 | Rogers | 248/95 X |
| 2,815,785 | 12/1957 | Vail | 150/1 |
| 2,895,521 | 7/1959 | Weber | 150/1 |
| 2,964,197 | 12/1960 | Wallace | 211/113 X |
| 3,495,763 | 2/1970 | Schmidt et al. | 229/54 |
| 3,512,701 | 5/1970 | Kamins et al. | 229/54 |
| 3,550,838 | 12/1970 | Hart | 229/54 |
| 4,282,911 | 8/1981 | Sumitomo | 150/1 |
| 4,375,232 | 3/1983 | Heescher et al. | 248/95 X |
| 4,787,522 | 11/1988 | Nocek et al. | 248/95 X |
| 4,832,290 | 5/1989 | Baglio | 248/95 |
| 4,854,530 | 8/1989 | Baglio | 248/95 |

FOREIGN PATENT DOCUMENTS

| | | | |
|---|---|---|---|
| 1919823 | 11/1969 | Fed. Rep. of Germany | 211/113 |
| 3620106 | 2/1987 | Fed. Rep. of Germany | 211/113 |

*Primary Examiner*—Karen J. Chotkowski

[57] ABSTRACT

A suspension hanger for a resealable plastic bag. The bag has upper and lower portions connected by a resealable seam. The suspension hanger comprises first and second matching panels, each panel including a substantially horizontal upper surface having exterior and interior edges. A substantially vertical exterior surface extends downward from the exterior edge of the upper surface. A substantially vertical interior surface extends downward from the interior edge of the upper surface. The interior vertical surface of each panel includes a first indentation lying below and separated from the upper horizontal surface of the panel by an upper portion of the vertical interior surface which projects beyond and overlies the first indentation. The first indentation is adapted for the disposition therein of the upper portion of the plastic bag. The interior vertical surface of each panel further includes a second indentation which is deeper than, continuous with, and lies below the first indentation. The second indentation terminates in an upturned lip which defines a first acute angle with the interior vertical surface of the panel. The upturned lip is adapted to indent the seam of a bag suspended therefrom. The interior vertical surfaces of the first and second panels are joined to one another above the first indentation. The first indentation in the panels forms a first channel for the disposition therein of the upper portion of the bag. The upturned lips of the second indentation in the panels define therebetween a second acute angle. The second indentation in the panels forms a second channel for the disposition of the seam of the bag, the seam being held indented and suspended by the upturned lips.

16 Claims, 3 Drawing Sheets

SUSPENSION HANGER FOR RESEALABLE PLASTIC BAG

BACKGROUND OF THE INVENTION

In general, the present invention relates to a bag support. More particularly, the invention relates to a hanging support for a resealable plastic bag. Manufacturing enterprises which produce consumer articles, especially though not exclusively in soft-goods lines, have found it desirable to pre-package their products in clear limp plastic bags. It has been customary to ship the products to wholesale and retail outlets in such pre-packaged bags. Retailers, however, have found that it is effective to display these pre-packaged goods in a hanging position suspended from supports instead of merely stacking the bagged goods on counters. The suspended bags present a neater appearance, and enable the customer to view the contents without disarranging the order, whereas if customers must shuffle through rows of stacked bags, the display is quickly disordered.

Additionally, it is very beneficial to use resealable plastic bags for the storage of articles or of files. By such means it is possible to store and file such material in a manner that is convenient, easily visible, and easily accessible.

It has been known to suspend these bags by some type of hook construction; however, the prior-art hangers are deficient in several respects.

For example, it has been found uneconomical to ship the goods in pre-packaged bags from which hangers protruded, because the hooks damaged adjacent bags and were difficult to pack. Additionally, the hangers occupied shipping space, resulting in increased shipping costs. Manufacturers were also reluctant to supply hangers with each display bag containing merchandise. It was a far more economical practice to allow the retailers to use their own hangers and to remove same for insertion into another bag when a sale was made. This gave the retailer the option of either hanging the bags or stacking them. Thus, the appearance of an unsightly hook projecting from each bag on a counter full of stacked bags would be avoided.

Moreover and most importantly, all of the prior-art embodiments utilize clamping means to suspend the plastic bag. Clamping means, however, have the following inherent disadvantages.

They damage the bag.

The bag is not readily removable.

The bag is not repetitively usable.

Clamp mechanisms are expensive to manufacture.

Any clamping mechanism requires a plurality of elements to function.

All clamping mechanisms are very non-uniform and uneven with respect to pressure distribution. This limits the weight which can be supported without ripping or tearing the seam of the bag.

The present invention provides for suspending a resealable plastic bag by a mechanism which is not subject to these disadvantages.

SUMMARY OF THE INVENTION

In general, the present invention provides a suspension hanger for a resealable plastic bag. The bag has upper and lower portions which are connected by a resealable seam.

A first embodiment of the suspension hanger comprises first and second matching panels. By "matching" panels is meant panels that are substantially identical, which have exterior and interior faces, and which are adapted to "mate" with one another by placing the interior faces in congruence. The panels have a vertical length sufficient to hold substantially the entire length of the bag therebetween.

Each panel includes a substantially horizontal upper surface having exterior and interior edges. A substantially vertical exterior surface extends downward from the exterior edge of the upper surface. A substantially vertical interior surface extends downward from the interior edge of the upper surface.

Each panel includes an indentation in the interior vertical surface of the panel. The indentation extends downward from a short distance below the upper horizontal surface of the panel. The indentation terminates in an upturned lip which defines a first acute angle with the interior vertical surface of the panel. The upturned lip is adapted to indent the seam of a bag suspended therefrom.

The vertical interior surfaces of the first and second panels are joined to one another above the indentation therein. The indentation in the first and second panels forms a first channel above the upturned lips and below the upper horizontal surface for the disposition of the upper portion of the bag.

The upturned lips of the first and second panels define therebetween a second acute angle. The upturned lips and the vertical interior surfaces of the first and second panels form a second channel for the disposition of the seam of the bag, the seam being held and supported by the upturned lips of the indentation. The suspension hanger thereby provides hanging support for the resealable plastic bag.

By "channel" is meant an opening, passageway, or recessed area adapted for the disposition therein of a portion of a resealable plastic bag. The first and second channels may, but need not be, continuous with one another.

A second embodiment of the suspension hanger comprises first and second matching panels, each panel including a substantially horizontal upper surface having exterior and interior edges. A substantially vertical exterior surface extends downward from the exterior edge of the upper surface. A substantially vertical interior surface extends downward from the interior edge of the upper surface.

The interior vertical surface of each panel includes a first indentation lying below and separated from the upper horizontal surface of the panel by an upper portion of the vertical interior surface which projects beyond and overlies the first indentation. The first indentation is adapted for the disposition therein of the upper portion of the plastic bag.

The interior vertical surface of each panel further includes a second indentation which is deeper than and lies below the first indentation. The second indentation terminates in an upturned lip which defines a first acute angle with the interior vertical surface of the panel. The upturned lip is adapted to indent the seam of a bag suspended therefrom. The first and second indentations may, but need not be, continuous with one another.

The interior vertical surfaces of the first and second panels are joined to one another above the first indentation. The first indentation in the panels forms a first channel for the disposition therein of the upper portion of the bag.

The upturned lips of the second indentation in the panels define therebetween a second acute angle. The second indentation in the panels forms a second channel for the disposition of the seam of the bag, the seam being held indented and suspended by the upturned lips.

DETAILED DESCRIPTION OF THE INVENTION

Figure 1:
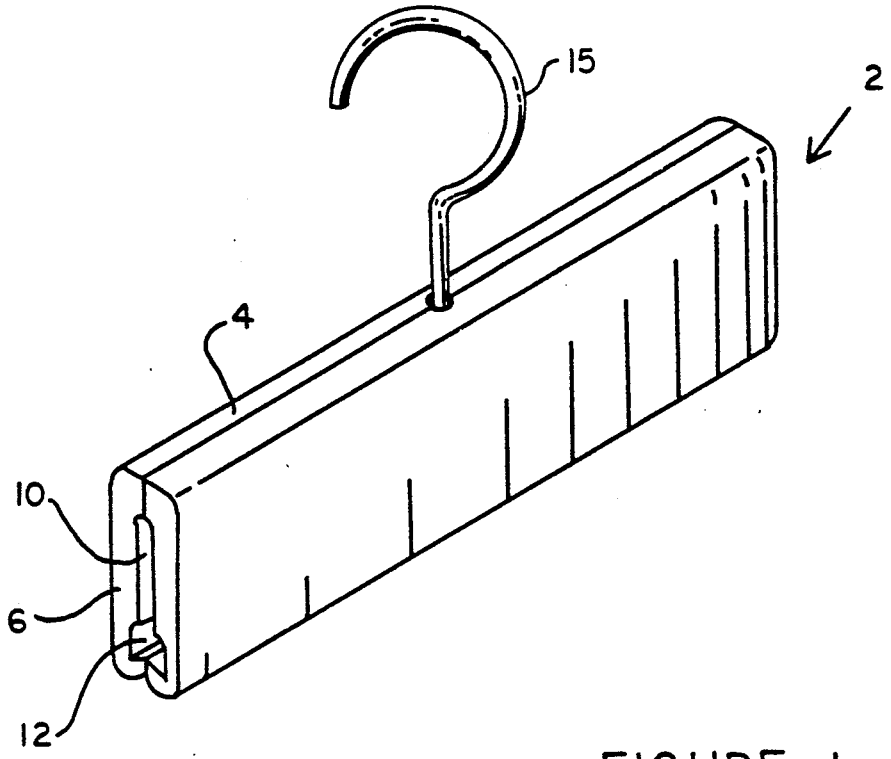
FIG. 1 is a schematic representation of a suspension hanger made in accordance with the principles of the present invention.
Figure 2:
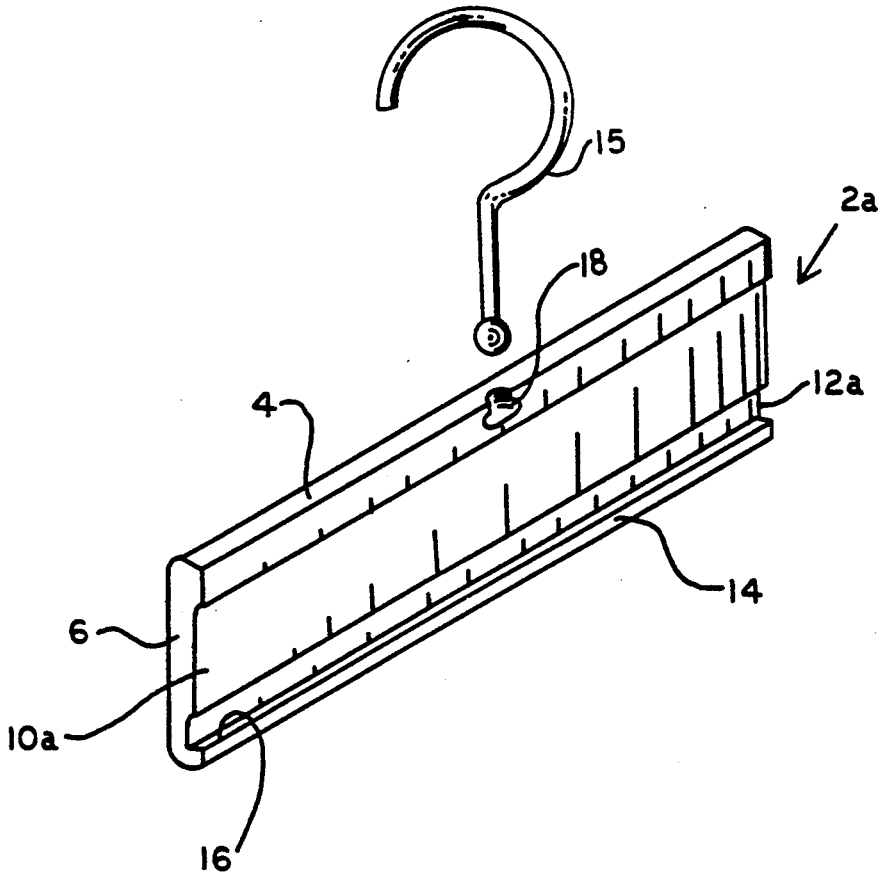
FIG. 2 is a schematic representation of one-half of the suspension hanger support shown in FIG. 1.

More specifically, reference is made to FIGS. 1-5, in which is shown the structure of a suspension hanger for a resealable plastic bag, made in accordance with the principles of the present invention.

The suspension hanger, generally designated by the numeral 2, comprises two halves, each of which is generally designated by the numeral 2*a*. Each half 2*a* of the hanger 2 comprises a top 4, a side body 6, and a hanger support 15 disposed and held in a hanger support groove 18 between the two halves 2*a*. The hanger 2 is formed by fastening the tops 4 of the two halves 2*a* to one another.

Each side body 6 includes a first indentation 10*a* for the disposition therein of the portion of a resealable plastic bag above the seam, and a second indentation 12*a* in which the seam of the bag is disposed and supported. Each second indentation 12*a* defines a suspension ledge support face 14 terminating in a V-shaped suspension ledge 16. In combination, the first indentations 10*a* in the interior vertical surfaces of the first and second panels form a first channel 10 for the disposition therein of the upper portion of the plastic bag. In combination, the second indentations 12*a* in the interior vertical surfaces of the first and second panels form a second channel 12 for the disposition therein of the seam of the bag. The first and second indentations from the side bodies 6 on one side of the hanger 2 to the side bodies 6 on the opposite side of the hanger 2.

It is critical that the second indentation 12*a* define an acute angle alpha (d) whereby the seam is slightly indented and prevented from slipping through the seam channel 12. By virtue of the angular structure of the second indentations 12*a* the seam is gripped and supportively held by the suspension ledges 16, thereby causing the seam 24 to overlap slightly the suspension ledges 16. This slight overlap opposes and equilibrates the lateral component of the gravitational force exerted by the bag against the suspension ledge support faces 14 acting to force the faces 14 apart.

Figure 5:
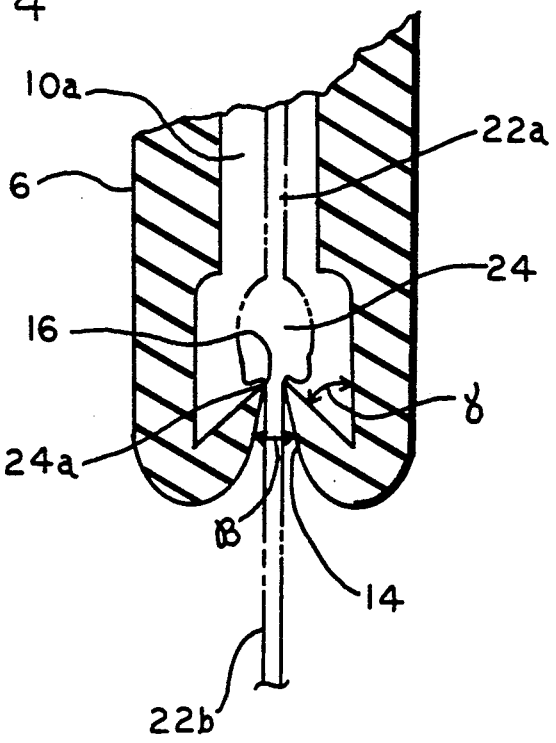
FIG. 5 is an exploded view of the lower portion of the hanger and bag shown in FIG. 3, showing the points of suspension and the angles defined by the structure of the hanger.

FIG. 5 shows that the two support faces 14 define a second angle beta (B) therebetween. The function performed by this angular aspect of the structure is to minimize the surface area of the support faces 14 making contact with the surface of the resealable bag. By virtue of this second angle beta the pressure of the suspension ledges 16 on the surface of the bag is maximized, ensuring a deeper indentation and a tighter grip on the seam of the bag.

Preferably, the magnitude of the first angle alpha is from about ten degrees to about eighty degrees. More preferably, the magnitude of the first angle alpha is from about thirty to about sixty degrees. Even more preferably, the magnitude of the first angle alpha is from about forty degrees to about fifty degrees.

Figure 3:
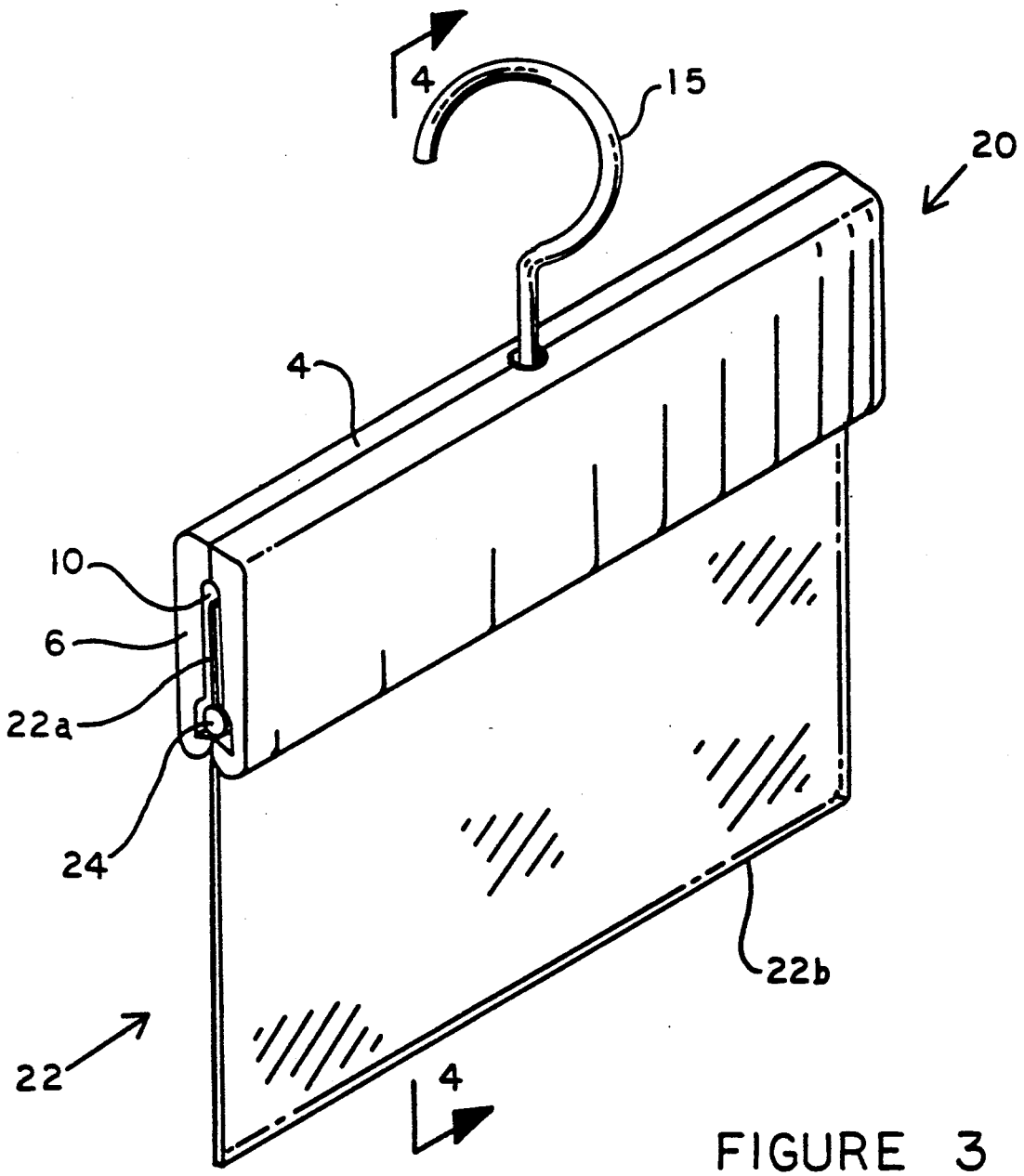
FIG. 3 is a schematic representation of a resealable plastic bag supported by a hanger support made in accordance with the principles of the present invention.
Figure 4:
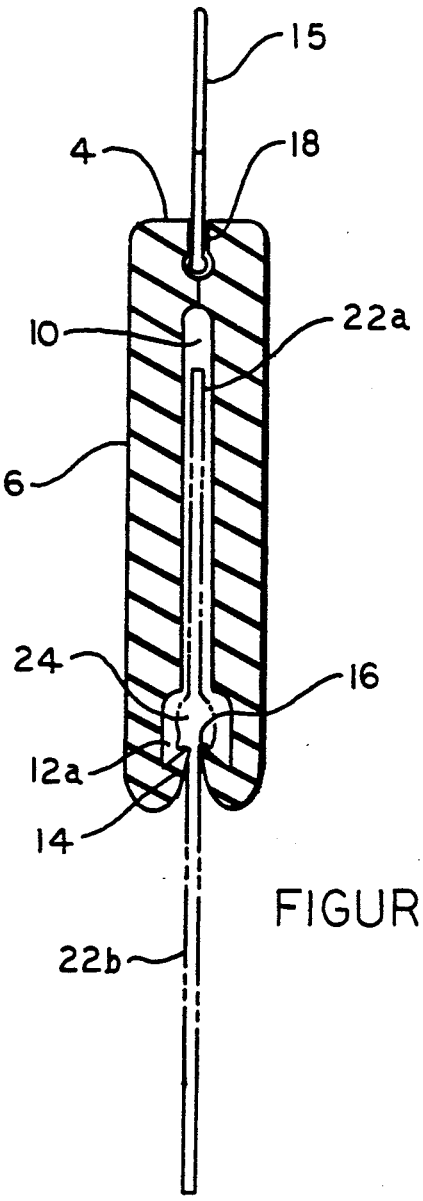
FIG. 4 is a cross-sectional view of the hanger and bag shown in FIG. 3, taken along the cutting line 4—4.

Reference is now made to FIG. 3-5, wherein is shown a resealable plastic bag 22 being supported by a hanger support 2 made in accordance with the principles of the present invention, the combination being generally identified by the numeral 20.

The bag 22 comprises a top portion 22*a*, a seam 24, and a lower portion 22*b*.

The top portion of the bag 22*a* and the seam 24 are inserted in the bag channel 10 and seam channel 12 of the suspension hanger 2 by sliding the seam 24 along the seam channel 12 until the outer edges of the bag 22 extend approximately to the outer edges of the side bodies 6 of the suspension hanger 2. At this point the suspension ledges 16, which before insertion of the bag 22 were barely touching with little or no tension, are now under sufficient tension to cause a slight indentation 24*a* in the seam 24 of the bag 22. When the combination 20 is supported by the support hanger 15 and allowed to hang freely from other support means such as a horizontal bar (not shown), the pressure exerted by the ledges 16 thrusting upward at an angle of approximately forty-five degrees against the seam 24 causes the indentation 24*a* to deepen.

The side bodies 6, support faces 14, and suspension ledges 16 are sufficiently stiff to prevent a widening of the gap between the suspension ledges 16, caused by insertion of the seam 24 therebetween, and to hold the suspension ledges 16 in proper alignment to support the bag 22 as close inboard as possible. The suspension ledges 16 are sufficiently stiff and sharp to indent the seam 24 as described.

Preferably, the material of construction for the suspension hanger 2, and more particularly for the parts of the suspension hanger 2 other than the hanger support 15, is an organic polymer. More preferably, the material is characterized as an organic polymeric resin. Even more preferably, the material is characterized as an organic polymer which has high creep resistance. Most preferably, the material is characterized as an organic polymeric resin having high creep resistance.

It is to be understood that the hanger support 15 shown in FIGS. 1-4 as disposed in the groove 18 is only exemplary and by no means limiting with respect to the type of hanger support which may be employed. Other examples which will readily occur to those skilled in the art include the hanger support 15 fastened to the top 4 by a screw, a hole formed in the top 4, and many other such modifications.

Moreover, the terms "joined" or "fastened" as used herein to describe the disposition and relationship of the two upper horizontal surfaces or tops 4 are defined to mean either (a) the attachment of the two surfaces 4 after separately fabricating the two halves 2*a*, or (b) fabricating the suspension hanger 2 as an integral unit; e.g., by injection molding. In the latter case, (b), the tops 4 would form an integral, continuous surface.

I claim:

1. A suspension hanger for a resealable plastic bag having upper and lower portions connected by a resealable seam, the suspension hanger comprising:

first and second matching panels having a length sufficient to hold substantially the entire length of the bag therebetween, each panel including (a) a substantially horizontal upper surface having exterior and interior edges;

(b) a substantially vertical exterior surface extending downward from the exterior edge of the upper surface;

(c) a substantially vertical interior surface extending downward from the interior edge of the upper surface; and (d) an indentation in the interior vertical surface of the panel, the indentation extending downward from a short distance below the upper horizontal surface of the panel and terminating in a V-shaped upturned lip projecting towards the upper horizontal surface of the panel and defining a first acute angle $\alpha$, the upturned lip being adapted to indent the seam of a bag suspended therefrom;

the vertical interior surfaces of the first and second panels being joined to one another above the indentation therein and separated from one another therebelow to permit insertion of the plastic bag therebetween, thereby forming a first channel above the upturned lips and below the upper horizontal surface for the disposition therein of the upper portion of the bag, the upturned lips of the first and second panels defining a second acute angle $\beta$ therebetween, the upturned lips of the indentation in the vertical surfaces of the first and second panels and the vertical interior surfaces of the panels forming a second channel for the disposition of the seam of the bag, the seam being indented, held, and supported by the upturned lips, the suspension hanger thereby providing hanging support for the resealable plastic bag.

2. The suspension hanger of claim 1, wherein the magnitude of the first acute angle is from about ten degrees to about eighty degrees.

3. The suspension hanger of claim 1, wherein the magnitude of the first acute angle is from about thirty degrees to about sixty degrees.

4. The suspension hanger of claim 1, wherein the magnitude of the first acute angle is from about forty to about fifty degrees.

5. The suspension hanger of claim 1, wherein the panels are sufficiently stiff to prevent a widening of a gap between the upturned lips, caused by insertion of the seam of the plastic bag therebetween, and to hold the upturned lips in proper alignment to support the bag as close inboard as possible.

6. The suspension hanger of claim 1, wherein the panels are made of an organic polymer having high creep resistance.

7. The suspension hanger of claim 1, wherein the panels are made of an organic polymeric resin having high creep resistance.

8. A suspension hanger for a resealable plastic bag having upper and lower portions connected by a resealable seam, the suspension hanger comprising:

first and second matching panels having a length sufficient to hold substantially the entire length of the bag therebetween, each panel including (a) a substantially horizontal upper surface having exterior and interior edges;

(b) a substantially vertical exterior surface extending downward from the exterior edge of the upper surface;

(c) a substantially vertical interior surface extending downward from the interior edge of the upper surface;

(d) a first indentation in the interior vertical surface of the panel, the first indentation lying below and separated from the upper horizontal surface of the panel by an upper portion of the vertical interior surface which projects beyond and overlies the first indentation, the first indentation being adapted for the disposition therein of the upper portion of the plastic bag; and (e) a second indentation in the interior vertical surface of the panel, the second indentation being deeper than and below the first indentation, the second indentation terminating in a V-shaped upturned lip projecting toward the upper horizontal surface of the panel and defining a first acute angle $\alpha$, the upturned lip being adapted to indent the seam of a bag suspended therefrom; vertical interior surface of the first and second panels being joined to one another above the first indentation therein and separated from one another therebelow to permit insertion of the plastic bag therebetween, the first indentation in the first and second panels forming a first channel for the disposition therein of the upper portion of the bag, the upturned lips of the second indentation in the first and second panels defining therebetween a second acute angle $\beta$, the second indentation in the first and second panels forming a second channel for the disposition of the seam of the bag, the seam being held and supported by the upturned lips, the suspension hanger thereby providing hanging support for the resealable plastic bag.

9. The suspension hanger of claim 8, wherein the magnitude of the first acute angle is from about ten to about eighty degrees.

10. The suspension hanger of claim 8, wherein the magnitude of the first acute angle is from about thirty to about sixty degrees.

11. The suspension hanger of claim 8, wherein the magnitude of the first acute angle is from about forty to about fifty degrees.

12. The suspension hanger of claim 8, wherein the panels are sufficiently stiff to prevent widening of a gap between the upturned lips, caused by insertion of the seam of the plastic bag therebetween, and to hold to upturned lips in proper alignment to support the bag as close inboard as possible.

13. The suspension hanger of claim 8, wherein the panels are made of an organic polymer having high creep resistance.

14. The suspension hanger of claim 8, wherein the panels are made of an organic polymeric resin having high creep resistance.

15. A resealable plastic bag and suspension hanger therefor, comprising:

(a) a resealable plastic bag and suspension hanger therefor, comprising:

(b) a suspension hanger constructed and arranged to provide hanging support for the plastic bag, the suspension hanger comprising first and second matching panels having a length sufficient to hold substantially the entire length of the bag therebetween, each panel having an exterior surface, an interior surface, an upper horizontal edge, a lower horizontal edge, a first vertical edge, and a second vertical edge, each panel including an indentation in the interior surface of the panel, the indentation extending downward from a short distance below the upper edge of the panel and terminating a short distance above the lower edge of the panel in a V-shaped upturned lip projecting towards the upper horizontal edge of the panel and defining a first acute angle $\alpha$, the lip being constructed and arranged to indent the seam of the bag, which is suspended therefrom, the interior surfaces of the first and second panels being joined to one another along the upper edge of each panel and separated from one another therebelow, thereby forming a first channel above the upturned lips and below the upper edge of the panels for the upper portion of the bag, the upturned lips of the first and second panels defining therebetween a second acute angle $\beta$, the upturned lips and the interior surfaces of the first and second panels forming a second channel in which the seam of the bag is disposed and held, the seam being indented, held, and supported by the upturned lips, the suspension hanger thereby providing hanging support for the resealable plastic bag.

16. A resealable plastic bag and suspension hanger therefor, comprising:

(a) a resealable plastic bag having upper and lower portions connected by a resealable seam; and (b) a suspension hanger constructed and arranged to provide hanging support for the plastic bag, the suspension hanger comprising first and second matching panels having a length sufficient to hold substantially the entire length of the bag therebetween, each panel having an exterior surface, and interior surface, an upper horizontal edge, a lower horizontal vertical edge, each panel including a first indentation in the exterior surface of the panel, the first indentation extending downward from a short distance below the upper edge of the panel and terminating near the lower edge of the panel in a second indentation, the second indentation being deeper than and lying below the first indentation, the second indentation terminating a short distance above the lower edge of the panel in a V-shaped upturned lip defining a first acute angle $\alpha$, the lip projecting towards the upper horizontal edge of the panel and being constructed and arranged to indent the seam of the bag, which is suspended therefrom, the interior surfaces of the first and second panels being joined to one another along the upper edge of each panel with the interior surfaces of the first and second panels in congruence and facing one another, thereby forming from the first indentations in the first and second panels a first channel for the upper portion of the bag, which is disposed therein, and forming from the upturned lips of the first and second panels and the second indentations in the first and second panels a second channel for the seam of the bag, which is disposed and held therein, the upturned lips of the first and second channels defining therebetween as second acute angle $\beta$, the seam of the bag being indented, held, and supported by the upturned lips the suspension hanger thereby providing hanging support for the resealable plastic bag.

* * * * *